US010980298B2

(12) United States Patent
Cai et al.

(10) Patent No.: US 10,980,298 B2
(45) Date of Patent: Apr. 20, 2021

(54) GLOVE STRUCTURE

(71) Applicant: LABORSING SAFETY PRODUCTS INC., Shanghai (CN)

(72) Inventors: Wenlan Cai, Shanghai (CN); Zhibin Li, Shanghai (CN); Ning Li, Shanghai (CN)

(73) Assignee: Shanghai Jin Feng Yu Glove Co., Ltd., Shanghai (CN)

( * ) Notice: Subject to any disclaimer, the term of this patent is extended or adjusted under 35 U.S.C. 154(b) by 212 days.

(21) Appl. No.: 16/236,972

(22) Filed: Dec. 31, 2018

(65) Prior Publication Data

US 2019/0133223 A1 May 9, 2019

Related U.S. Application Data

(63) Continuation-in-part of application No. 15/035,998, filed as application No. PCT/CN2014/090527 on Nov. 7, 2014, now abandoned.

(30) Foreign Application Priority Data

| | | |
|---|---|---|
| Nov. 12, 2013 | (CN) | 201310560492.5 |
| Nov. 12, 2013 | (CN) | 201310560501.0 |
| Nov. 12, 2013 | (CN) | 201310560503.X |
| Nov. 12, 2013 | (CN) | 201310561245.7 |
| Nov. 12, 2013 | (CN) | 201320711864.5 |
| Nov. 12, 2013 | (CN) | 201320711865.X |
| Nov. 12, 2013 | (CN) | 201320712624.7 |
| Nov. 12, 2013 | (CN) | 201320712636.X |
| Nov. 4, 2014 | (CN) | 201410614267.X |
| Nov. 4, 2014 | (CN) | 201420653789.6 |

(51) Int. Cl.
*A41D 19/015* (2006.01)

(52) U.S. Cl.
CPC ..... *A41D 19/01547* (2013.01); *A41D 19/015* (2013.01); *A41D 2300/52* (2013.01)

(58) Field of Classification Search
CPC ..... A41D 19/015; A41D 19/01547; A41D 2300/52
USPC ..... 2/163, 169
See application file for complete search history.

(56) References Cited

U.S. PATENT DOCUMENTS

| | | | | |
|---|---|---|---|---|
| 2,433,327 A * | 12/1947 | Anderson | A41D 19/0068 | 2/169 |
| 2,970,317 A * | 2/1961 | Winson | A41D 19/0068 | 2/169 |
| 6,539,552 B1 * | 4/2003 | Yoshida | A41D 19/0006 | 2/161.6 |
| 6,625,816 B1 * | 9/2003 | Cooke | A41D 19/0062 | 2/161.5 |

* cited by examiner

*Primary Examiner* — Katherine M Moran
(74) *Attorney, Agent, or Firm* — Rosenberg, Klein & Lee

(57) ABSTRACT

A glove structure of the present invention has a glove palm, a glove back and an edging. The edging is a bent sheet and has an upper side edge and a lower side edge, wherein the lower and upper side edges are respectively adhered to the glove palm and the glove back via joining regions, and the lower and upper side edges bend toward the glove palm. Thus, the whole glove structure bends along a direction being from the glove back to the glove back to make the glove structure be a ergonomics structure which the fingers bend toward the glove palm when the human hand is under a working state or a general state without force.

20 Claims, 18 Drawing Sheets

GLOVE STRUCTURE

CROSS-REFERENCE TO RELATED APPLICATIONS

This application is a continuation-in-part of U.S. patent application Ser. No. 15/035,998, filed May 11, 2016, which is a national stage of International Patent Application No. PCT/CN2014/090527, filed Nov. 7, 2014. The contents of each of the above are included in this application by reference.

BACKGROUND OF THE INVENTION

(a) Field of the Invention

The present invention relates to a glove structure, and more particularly to a glove structure that is simple, easily produced, and can substantially increase production efficiency and glove quality. Moreover, a simple bonding method is used to cut the cost of stitching done by hand, shorten the staff learning curve, reduce operational variables, and make the glove structure fit ergonomics.

(b) Description of the Prior Art

The different manufacturing methods of existing gloves can generally be divided into injection molded gloves and sewn gloves. And of the two types of gloves, the present invention primarily focuses on providing additional improvement to sewn gloves.

A plurality of glove cut pieces must be first produced when producing general sewn gloves, and then hand or mechanical methods are used to sew together each of the glove cut pieces one by one to complete a glove structure. However, using hand or mechanical methods to carry out the sewing involves a relatively long working time with relatively poor production efficiency. Moreover, because of careless mistakes made by workers or operational variables, the quality of the gloves is often affected during the sewing process, which decreases the up-to-standard rate of the gloves. Hence, in order to reduce careless mistakes made by workers or operational variables, it is necessary to reinforce staff training and improve the staff learning curve, which further adds to the cost of hand sewing.

Further, regarding ergonomics, fingers of a human hand bend toward a palm with that a non-flat angle is formed between the fingers and the palm when the human hand is under a working state (for example, holding an object) or a general state without force. However, a finger section of a general stitched glove and a palm section of the general stitched glove have a flat angle therebetween, i.e. show a flat status, and this glove does not match to the human hand when considering the ergonomics hand shape. Since the general stitched glove does not fit the ergonomics, it makes the user feel comfortless when wearing it.

SUMMARY OF THE INVENTION

In light of the shortcomings of the prior art, the present invention provides a glove structure, and more particularly a glove structure that is simple, easily produced, and can substantially increase production efficiency and glove quality. Moreover, a simple bonding method is used to cut the cost of stitching done by hand, shorten the staff learning curve, reduce operational variables, and make the glove structure fit ergonomics.

In order to achieve the aforementioned object, a glove structure of the present invention is provided with first and second glove components, wherein the first glove component is correspondingly provided with a first internal surface and a first external surface, and the second glove component is correspondingly provided with a second internal surface and a second external surface. The second internal surface uses joining regions to bond to the first external surface, or the first internal surface and the second internal surface form a holding space, with the second internal surface using joining regions to bond to the first external surface. The glove structure of the present invention not only provides a simple structure that is easily produced, but also substantially increases production efficiency and glove quality. Moreover, a simple bonding method is used to cut the cost of stitching done by hand, shorten the staff learning curve, and reduce operational variables.

Based on the aforementioned technological characteristics, a connecting portion between the first glove component and the second glove component is used to connect and form an integral body.

The present invention further provides a glove structure comprising at least one of the first glove components, the second glove component, and a third glove component, wherein the first glove component is correspondingly provided with the first internal surface and the first external surface, and the second glove component is correspondingly provided with the second internal surface and the second external surface. The third glove component uses joining regions to bond to the first glove component, or the second glove component; or the first internal surface and the second internal surface form a holding space, with the third glove component uses joining regions to bond to the first or the second glove components.

Based on the aforementioned technological characteristics, the first glove component is a glove palm, and the second glove component is a glove back.

Based on the aforementioned technological characteristics, the first glove component is provided with at least one cut piece, or the second glove component is provided with at least one cut piece.

Based on the aforementioned technological characteristics, the glove back is provided with a back portion and a second fingers portion located on one side of the back portion, the glove palm is provided with a glove palm portion and a first fingers portion located on one side of the glove palm portion, and the joining regions are positioned on the second glove component.

Based on the aforementioned technological characteristics, the joining regions are configured as bonding layers.

Based on the aforementioned technological characteristics, the joining regions use high frequency or compression methods to join the first glove component to the second glove component.

The present invention further provides a glove structure which at least comprises: a first glove component being a glove palm which has a glove palm portion and a first fingers portion located on one side of the glove palm portion, wherein the first fingers portion comprises a plurality of fingers; a second glove component being a glove back which has a back portion and a second fingers portion located on one side of the back portion, wherein the second fingers portion comprises a plurality of rear fingers; and at least a third glove component being an edging, the edging is a bent sheet, the edging has a left wing portion and a right wing portion connected to the left wing portion, a left-lower edge of the of the left wing portion and a right-lower edge of the right wing portion are connected to each other to form a lower side edge, and a left-upper edge of the of the left wing portion and a right-upper edge of the right wing portion are connected to each other to form an upper side edge; the lower side edge is adhered to at least one portion of the glove palm via a joining region, the upper side edge is adhered to at least one portion of the glove back via another joining region, and the lower side edge and the upper side edge bend toward a common side of the edging.

Based on the aforementioned technological characteristics, the lower side edge is bent toward the glove palm.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1A:
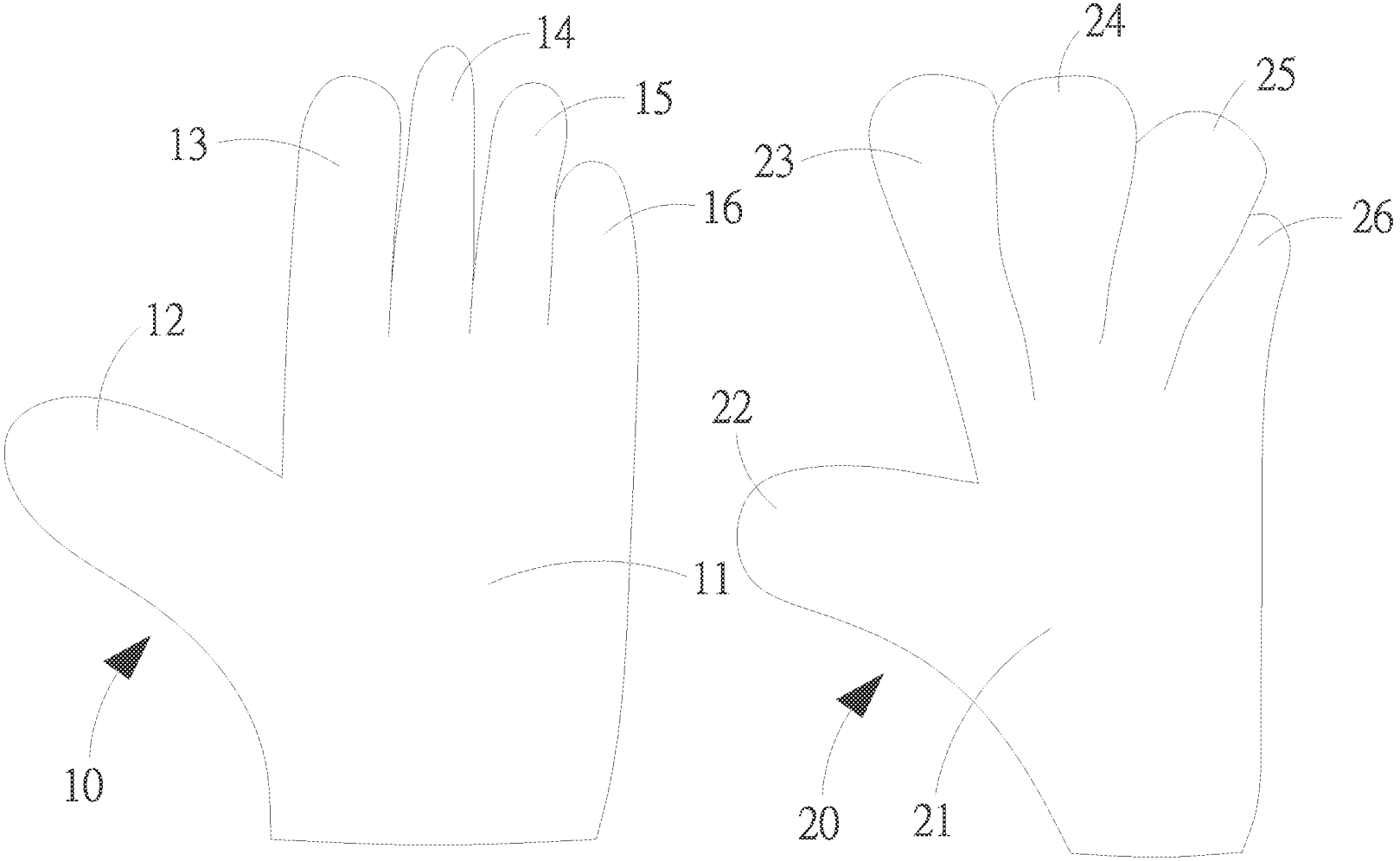
FIGS. 1A-1D are structural schematic views of a first embodiment of a glove of the present invention.
Figure 1B:
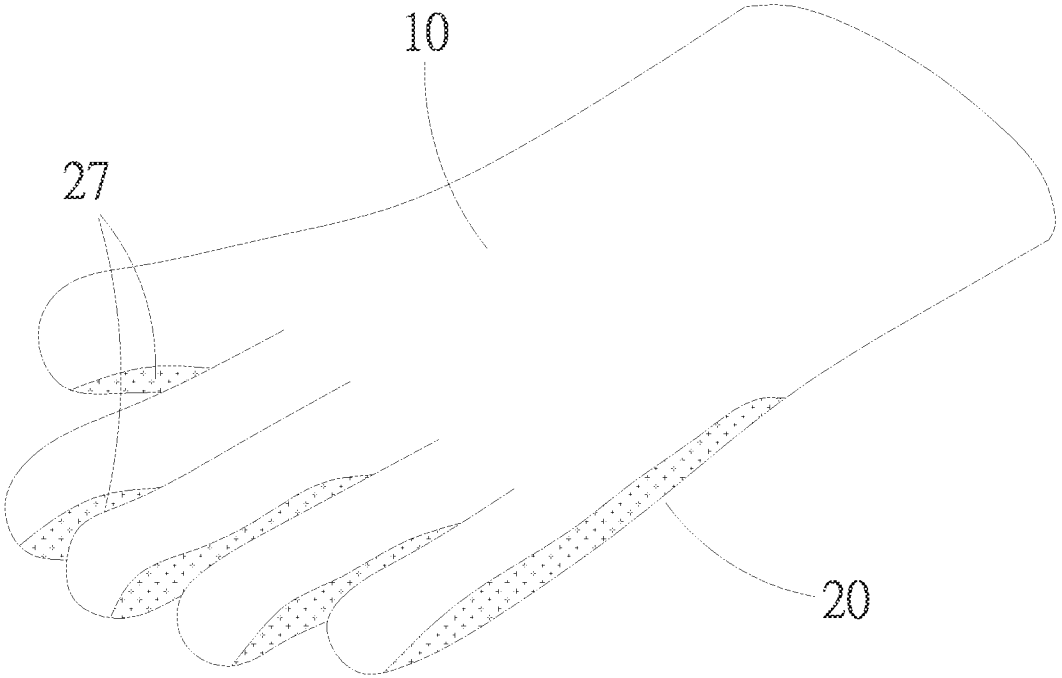

Referring to FIGS. 1A and 1B, which show structural schematic views of a first embodiment of a glove of the present invention, wherein a glove structure of the present invention is provided with first and second glove components. In the embodiment depicted in the drawings, a glove palm 10 is an example of the first glove component, and a glove back 20 is an example of the second glove component. The glove palm 10 is provided with a glove palm portion 11 and a first fingers portion located on one side of the glove palm portion 11, wherein the first fingers portion comprises a plurality of fingers comprising a thumb 12, an index finger 13, a middle finger 14, a ring finger 15, and a little finger 16, which integrally extend from and are formed on one side of the glove palm portion 11. Moreover, the first glove component is made up from a single cut piece, and the glove back 20 is provided with a back portion 21 and a second fingers portion located on one side of the back portion 21, wherein the second fingers portion comprises a plurality of rear fingers comprising a rear thumb 22, a rear index finger 23, a rear middle finger 24, a rear ring finger 25, and a rear little finger 26, which integrally extend from and are formed on one side of the back portion 21. Moreover, the second glove component is made up from a single cut piece. In the aforementioned embodiment, the first and second fingers portions are formed as complete finger shapes, and it is understood that they may also take the form of half finger shapes.

Figure 1C:
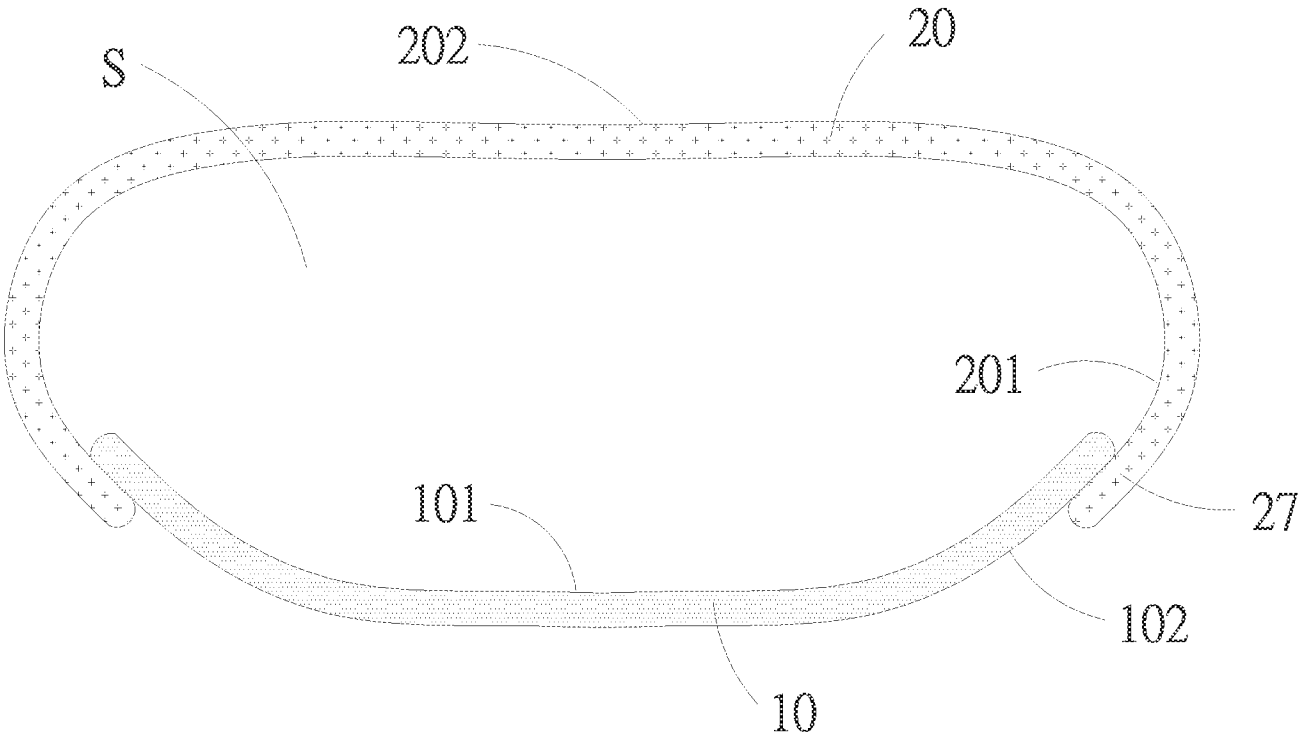
Figure 1D:
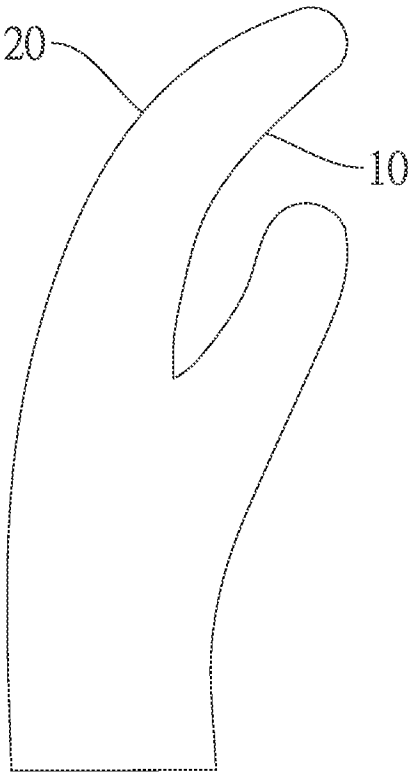

Referring together with FIGS. 1C and 1D, wherein the glove back 20 overlaps one side of the glove palm 10, and the glove palm 10 of the first glove component is correspondingly provided with a first internal surface 101 and a first external surface 102, and the glove back 20 of the second glove component is correspondingly provided with a second internal surface 201 and a second external surface 202. Moreover, the first internal surface 101 and the second internal surface 201 form a holding space S. Joining regions 27 are used to bond at least one portion of the second internal surface 201 to the first external surface 102, wherein the joining regions 27 are located on peripheral areas of the glove back 20 of the second glove component. As an example, the length of the peripheral areas from the ends of the glove back 20 of the second glove component is greater than 0 cm and less than or equal to 5 cm. A cross sectional length of the glove back 20 is larger than a cross sectional length of the glove palm 10, or an area of the glove back 20 is larger than an area of the glove palm. The joining regions 27 enable bonding the glove palm 10 of the first glove component to the glove back 20 of the second glove component to make the whole glove structure bend along a direction from the glove back 20 to the glove palm 10, and thus a three-dimensional structure fitting ergonomics is formed. Particularly, the area of the back portion 21 is larger than that of the glove palm portion 11, and a concave is formed at the glove palm portion 11 to make the glove structure more fit the human hand shape. Additionally, preferably, an area of the second fingers portion is larger than an area of the first fingers portion. More preferably, an area of the rear thumb 22 is larger than that of the thumb 12, an area of the rear index finger 23 is larger than that of the index finger 13, an area of the rear middle finger 24 is larger than that of the middle finger 14, an area of the rear ring finger 25 is larger than that of the ring finger 15, and an area of the rear little finger 26 is larger than that of the little finger 16, such that the whole structure bends along the direction from "the rear thumb 22, the rear index finger 23, the rear middle finger 24, the rear ring finger 25 and the rear little finger 26" respectively to "the thumb 12, the index finger 13, the middle finger 14, the ring finger 15 and the little finger 16", and the three-dimensional structure fitting ergonomics is formed. The aforementioned joining regions 27 may be configured as bonding layers (not shown in the drawings), and the bonding layers can be adhesive interface materials such as polyurethane (abbreviated to PU) or acrylate, which may be attached using methods such as sticking with an adhesive coating or pasting with glue. Accordingly, the bonding layers enable forming a fixed bonding of the glove back 20 to the glove palm 10. It is understood that high frequency, thermal compression bonding, or cold compression bonding methods can also be used to form the fixed bonding.

Figure 2:
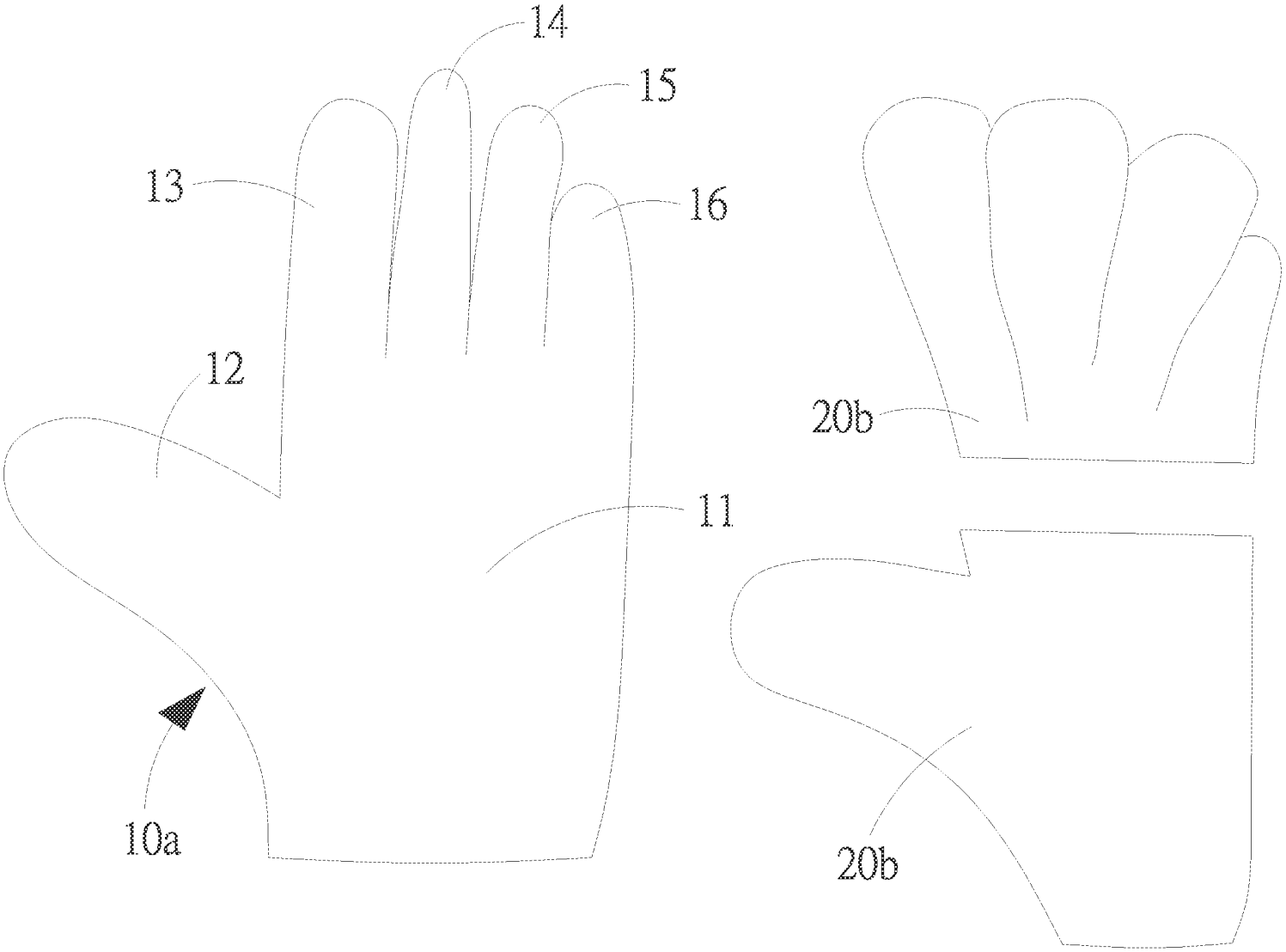
FIG. 2 is a structural schematic view of a second embodiment of the glove of the present invention.

The aforementioned first glove component comprises at least one cut piece, or the second glove component comprises at least one cut piece. Referring to a second embodiment as depicted in FIG. 2, wherein the glove palm 10 is provided with the glove palm portion 11 and a first fingers portion located on one side of the glove palm portion 11. The first fingers portion comprises the thumb 12, the index finger 13, the middle finger 14, the ring finger 15, and the little finger 16, which integrally extend from and are formed on one side of the glove palm portion 11. The first glove component is made up from a single cut piece 10*a*, and the second glove component comprises two cut pieces 20*b*.

Figure 3:
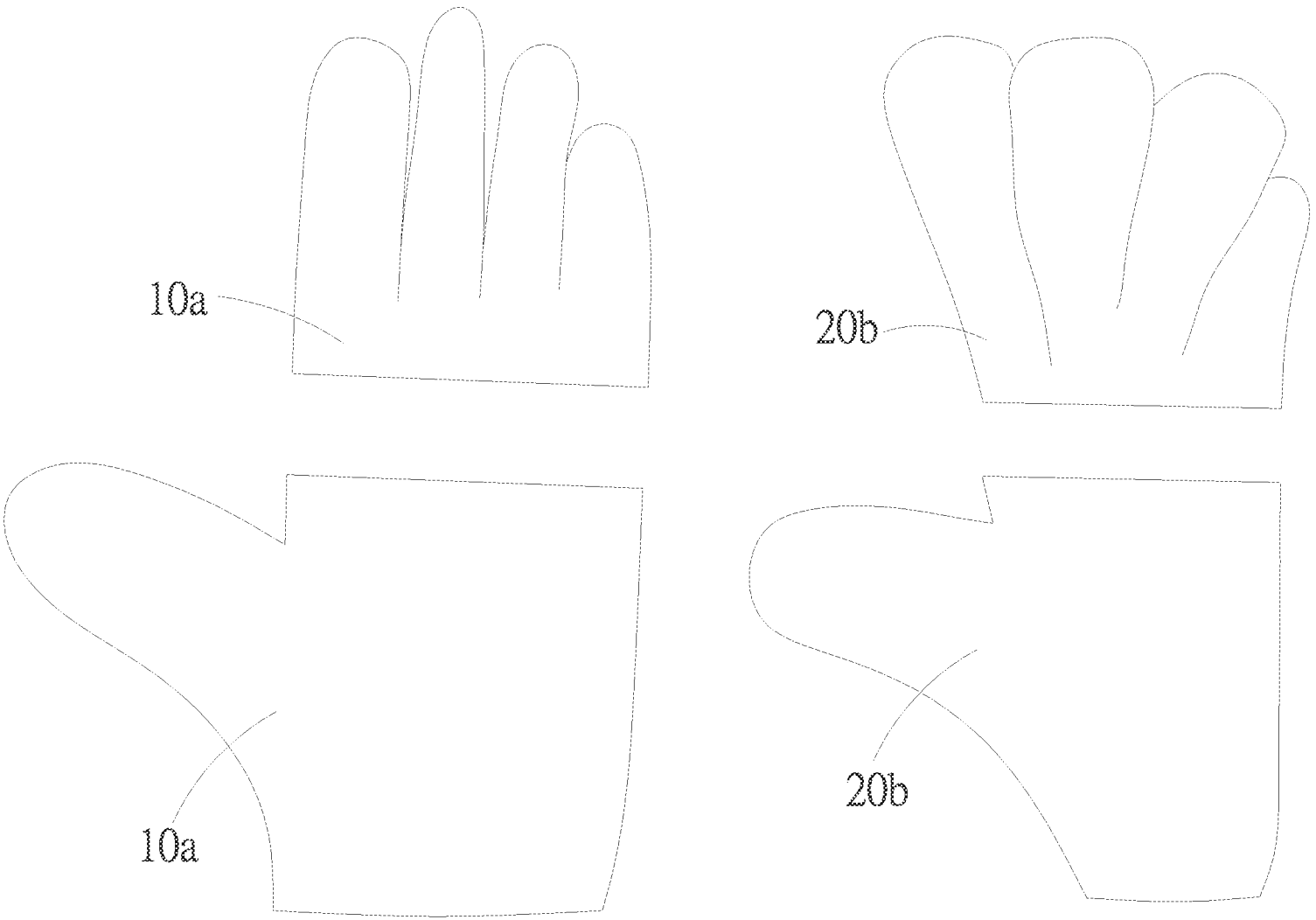
FIG. 3 is a structural schematic view of a third embodiment of the glove of the present invention.

Referring to a third embodiment as depicted in FIG. 3, the first glove component is made up from two of the cut pieces 10*a*, and the second glove component is made up from the two cut pieces 20*b*.

Figure 4:
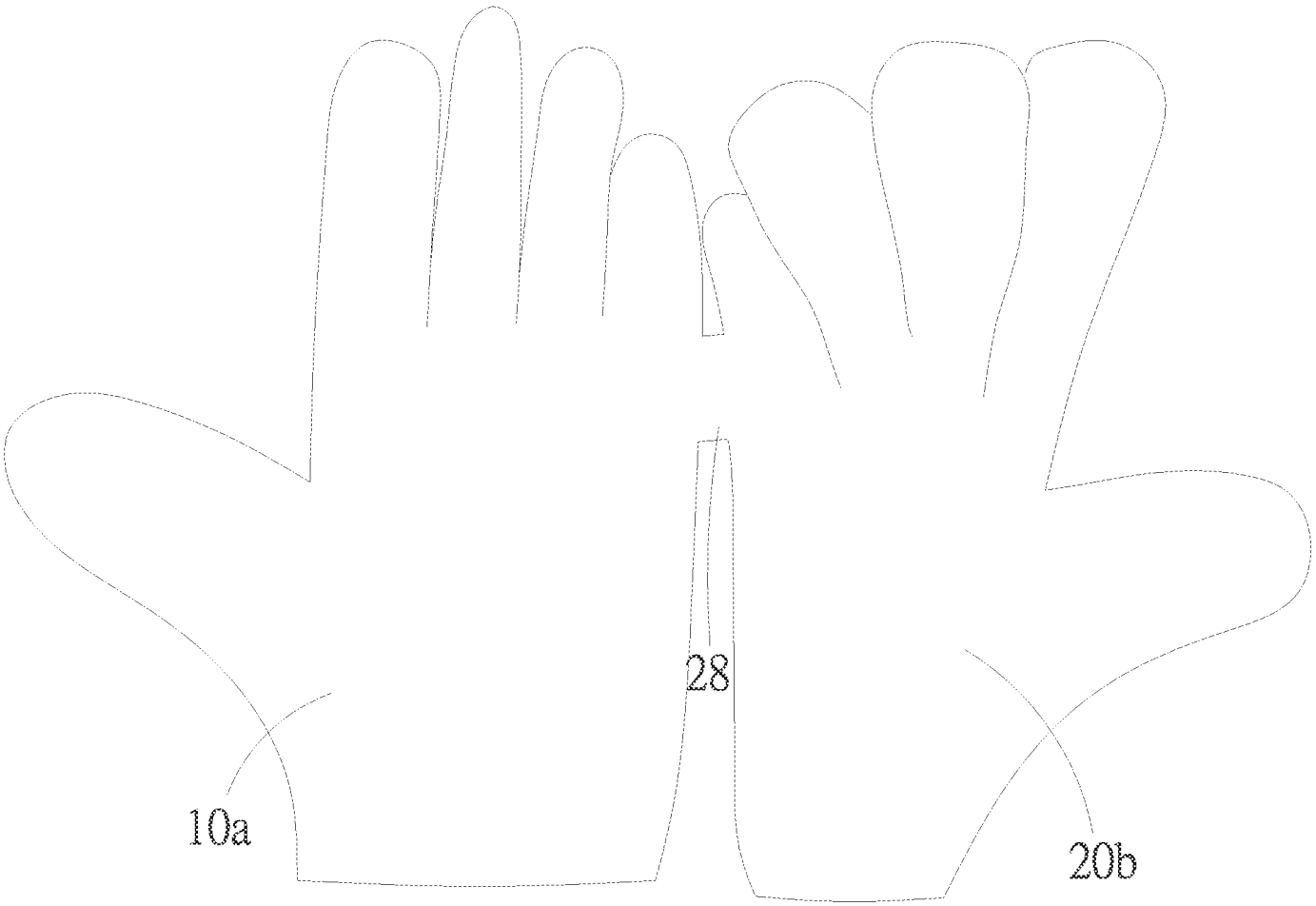
FIG. 4 is a structural schematic view of a fourth embodiment of the glove of the present invention.

Referring to a fourth embodiment as depicted in FIG. 4, wherein the glove structure comprises first and second glove components, and in the embodiment depicted in the drawing, the first glove component is a glove palm and the second glove component is a glove back. A connecting portion 28 between the first glove component and the second glove component is used to connect the glove palm and the glove back to form an integral body. The first glove component is made up from the single cut piece 10*a*, and the second glove component is made up from the single cut piece 20*b*. The connecting portion 28 is used to form a fixed bonding between the glove back and the glove palm to form the glove structure as depicted in FIG. 1*b*.

Figure 5:
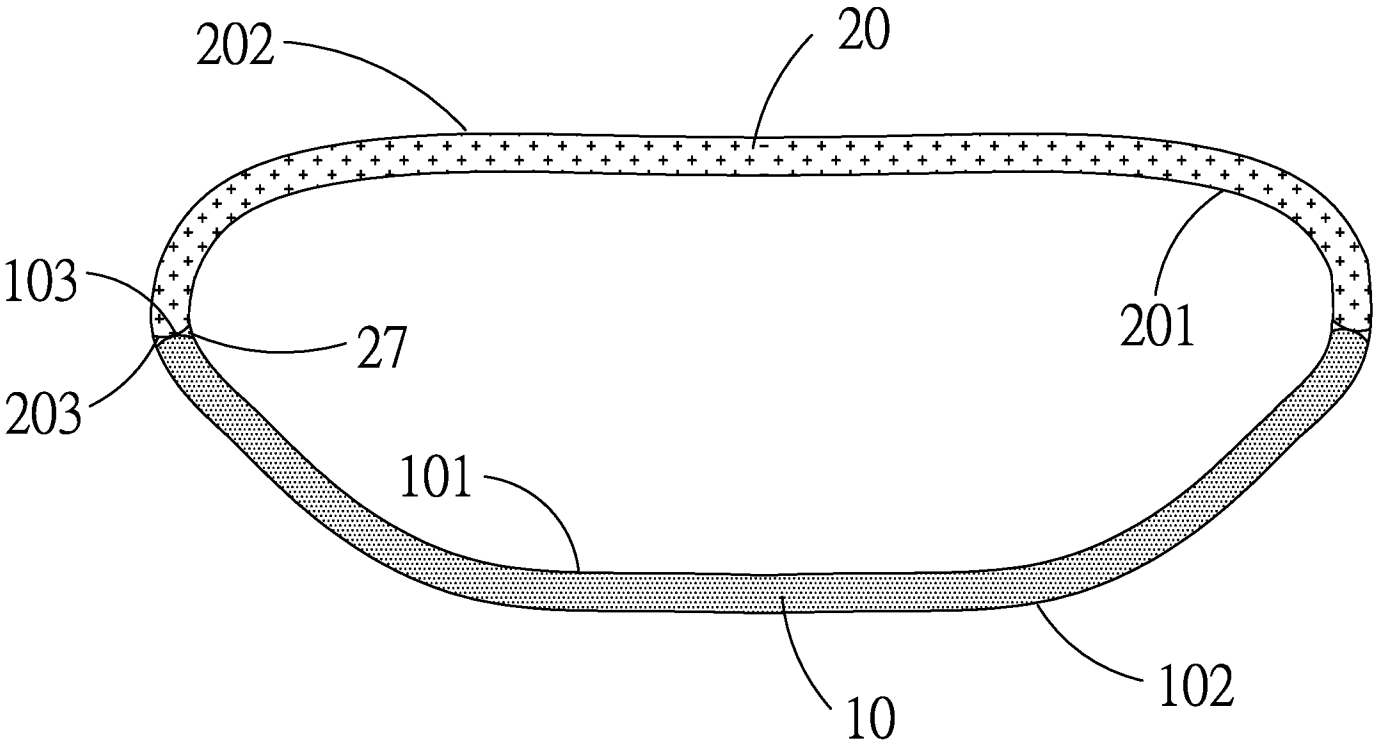
FIG. 5 is a structural schematic view of a fifth embodiment of the glove of the present invention.

Referring to a fifth embodiment as depicted in FIG. 5, wherein a glove structure of the present invention is provided with first and second glove components. An example of the first glove component is the glove palm 10, and an example of the second glove component is the glove back 20. The first glove component is correspondingly provided with the first internal surface 101 and the first external surface 102, and first cross sections 103 are located between the first internal surface 101 and the first external surface 102. The second glove component is correspondingly provided with the second internal surface 201 and the second external surface 202, and second cross sections 203 are located between the second internal surface 201 and the second external surface 202. The joining regions 27 are used to bond the first cross sections 103 to the second cross sections 203. Being similar to the first embodiment, in the fifth embodiment, the cross sectional length of the glove back 20 is larger than that of the glove palm 10, or the area of the glove back 20 is larger than that of the glove palm 10, and the glove palm 10 of the first glove component is connected to the glove back 20 of the second glove component via joining regions 27, such that the whole glove structure bends along the direction from the glove back 20 to the glove palm 10 to form a three-dimensional structure fitting the ergonomics. Particularly, the area of the back portion 21 is larger than that of the glove palm portion 11, and a concave is formed at the glove palm portion 11 to make the glove structure more fit the human hand shape. In addition, preferably, the area of the second fingers portion is larger than that of the first fingers portion. More preferably, the area of the rear thumb 22 is larger than that of the thumb 12, the area of the rear index finger 23 is larger than that of the index finger 13, the area of the rear middle finger 24 is larger than that of the middle finger 14, the area of the rear ring finger 25 is larger than that of the ring finger 15, and the area of the rear little finger 26 is larger than that of the little finger 16, such that the whole structure bends along the direction from "the rear thumb 22, the rear index finger 23, the rear middle finger 24, the rear ring finger 25 and the rear little finger 26" respectively to "the thumb 12, the index finger 13, the middle finger 14, the ring finger 15 and the little finger 16", and the three-dimensional structure fitting ergonomics is formed. The aforementioned joining regions 27 may be configured as bonding layers, and the bonding layers can be adhesive interface materials such as polyurethane (abbreviated to PU) or acrylate, which may be attached using methods such as sticking with an adhesive coating or pasting with glue. Accordingly, the bonding layers enable forming a fixed bonding of the first and second glove components. It is understood that high frequency, thermal compression bonding, or cold compression bonding methods can also be used to form the fixed bonding.

Figure 6A:
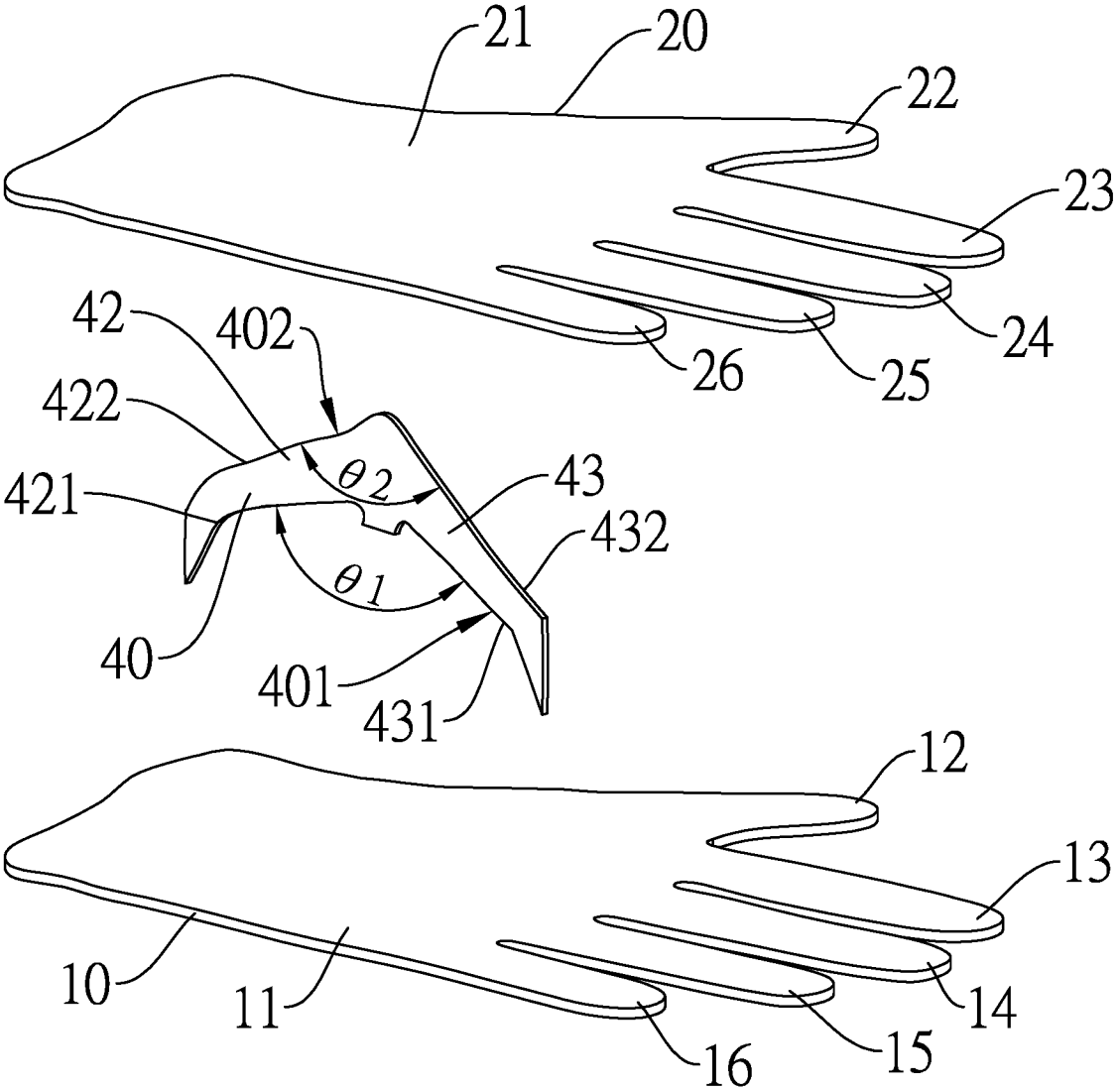
FIGS. 6A-6E are structural schematic views of a sixth embodiment of the glove of the present invention.
Figure 6B:
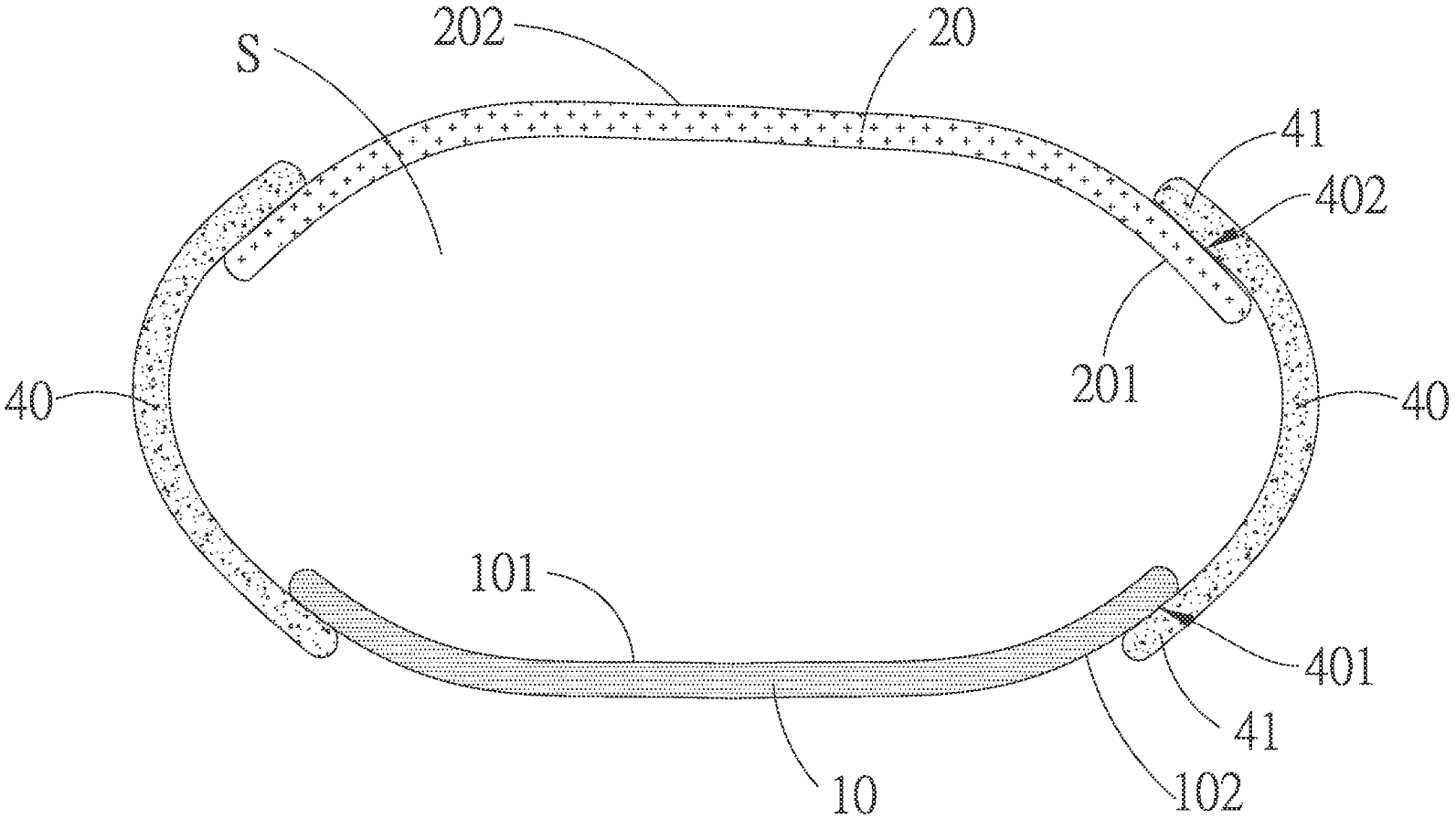

The glove structure having the three-dimensional structure which fits ergonomics can be shown in a sixth embodiment as depicted in FIGS. 6A and 6B, the glove structure is provided with a first glove component, a second glove component, and at least one third glove component, an example of which is an edging 40. And in the embodiment depicted in the drawing, the first glove component is the glove palm 10, the second glove component is the glove back 20, and the embodiment is further provided with at least one edging 40, which is located between the glove palm 10 and the glove back 20. The first internal surface 101 of the first glove component and the second internal surface 201 of the second glove component form the holding space S. Two sides of the at least one edging 40 respectively use a joining region 41 to bond together the first and second glove components. As an example, a peripheral area on one side of the edging 40 uses a bonding method to connect at least one portion of the glove palm 10 (the first external surface 102 is used as an example in the drawings), and a peripheral area on another side of the edging 40 uses a bonding method to connect at least one portion of the glove back 20 (the second external surface 202 is used as an example in the drawings). The length of the peripheral areas from the ends of the edging 40 is greater than 0 cm and less than or equal to 5 cm. It is understood that a peripheral area on one side of the edging 40 can also use a bonding method to connect the first internal surface 101 of the glove palm 10, and a peripheral area on the other side of the edging 40 can use a bonding method to connect the second internal surface 201 of the glove back 20. The glove structure in FIG. 6B has two edgings 40 respectively located between two sides of the glove palm 10 and two sides of the glove back 20.

The thumb 12, the index finger 13, the middle finger 14, the ring finger 15, and the little finger 16 of the first fingers portion integrally extend from and are formed on one side of the glove palm portion 11. Moreover, the first glove component is made up from the single cut piece, and the glove back 20 comprises the back portion 21 and a second fingers portion located on one side of the back portion 21, wherein the second fingers portion comprises the rear thumb 22, the rear index finger 23, the rear middle finger 24, the rear ring finger 25, and the rear little finger 26, which integrally extend from and are formed on one side of the back portion 21. Furthermore, the second glove component is made up from the single cut piece. Certainly, in the sixth embodiment, it is understood that in the fifth embodiment the first glove component can be configured with at least one cut piece, or the second glove component can also be configured with at least one cut piece.

Further, in the above embodiment, the first glove component is the glove palm 10, and the second glove component is the glove back 20. Being similar to the first embodiment, in the sixth embodiment, the cross sectional length of the glove back 20 is larger than that of the glove palm 10, or the area of the glove back 20 is larger than that of the glove palm 10, and the glove palm 10 of the first glove component is connected to the glove back 20 of the second glove component via joining regions 41, such that the whole glove structure bends along the direction from the glove back 20 to the glove palm 10 to form a three-dimensional structure fitting the ergonomics. Particularly, the area of the back portion 21 is larger than that of the glove palm portion 11, and a concave is formed at the glove palm portion 11 to make the glove structure more fit the human hand shape. In addition, preferably, the area of the second fingers portion is larger than that of the first fingers portion. More preferably, the area of the rear thumb 22 is larger than that of the thumb 12, the area of the rear index finger 23 is larger than that of the index finger 13, the area of the rear middle finger 24 is larger than that of the middle finger 14, the area of the rear ring finger 25 is larger than that of the ring finger 15, and the area of the rear little finger 26 is larger than that of the little finger 16, such that the whole structure bends along the direction from "the rear thumb 22, the rear index finger 23, the rear middle finger 24, the rear ring finger 25 and the rear little finger 26" respectively to "the thumb 12, the index finger 13, the middle finger 14, the ring finger 15 and the little finger 16", and the three-dimensional structure fitting ergonomics is formed.

Further, as shown in the sixth embodiment of FIG. 6A, the edging 40 is a bent sheet, the edging 40 has a left wing portion 42 and a right wing portion 43 connected to the left wing portion 42. A left-lower edge 421 of the left wing portion 42 and the right-lower edge 431 of the right wing portion 43 have a lower angle θ1 therebetween, and the lower angle θ1 is less than 180 degrees. Preferably, the lower angle θ1 is less than 180 degrees and larger than 90 degrees. A left-upper edge 422 of the left wing portion 42 and a right-upper edge 432 of the right wing portion 43 have an upper angle θ2 therebetween, and the upper angle θ2 is less than 180 degrees. Preferably, the upper angle θ2 is less than 180 degrees and larger than 90 degrees. The upper angle θ2 is larger than, less than or equal to the lower angle θ1. When the upper angle θ2 is less than the lower angle θ1, a width of a location which the left wing portion 42 is connected to the right wing portion 43 is larger than a width of a terminal of the left wing portion 42, and the width of the location which the left wing portion 42 is connected to the right wing portion 43 is larger than a width of a terminal of the right wing portion 43. Certainly and alternatively, the width of a location which the left wing portion 42 is connected to the right wing portion 43 can be less than the width of the terminal of the left wing portion 42, or the width of the location which the left wing portion 42 is connected to the right wing portion 43 can be less than the width of the terminal of the right wing portion 43. The left-lower edge 421 and the right-lower edge 431 are connected to each other to form a lower side edge 401, and the left-upper edge 422 and the right-upper edge 432 are connected to each other to form an upper side edge 402. The lower side edge 401 and the upper side edge 402 are respectively adhered to the first glove component and the second glove component via the joining regions 41. The lower side edge 401 is adhered to at least one portion of the glove palm 10 via one of the joining regions 41 (take the first outer surface 102 in drawings as an example), and the upper side edge 402 is adhered to at least one portion of the glove back 20 via another one of the joining regions 41 (take the second outer surface 202 in drawings as an example). A length of the left wing portion 42 is equal to or not equal to that of the right wing portion 43. Further, the lower side edge 401 and the upper side edge 402 bend toward the glove palm 10 to form the lower angle θ1 and the upper angle θ2, such that the whole glove structure bends along the direction from the glove back 20 to the glove palm 10 to form a three-dimensional structure fitting the ergonomics. Preferably, the upper angle θ2 is less than the lower angle θ1, such that the glove back 20 more bends toward the glove palm 10, and the glove structure more fits the ergonomics. More preferably, two sides which the left wing portion 42 and right wing portion 43 are connected to each other are respectively connected to a location which the glove palm portion 11 is connected to the finger (such as, the little finger 16) and a location which the back portion 21 is connected to the rear finger (such as, the rear little finger 26), thus the finger (such as, the little finger 16) bends toward the glove palm 10, and the glove structure more fits the ergonomics and the requirements of any working states. In other words, the lower side edge 401 and the upper side edges 402 bend toward a common side of the edging to form the lower angle θ1 and the upper angle θ2, respectively. For example, the lower side edge 401 and the upper side edge 402 in FIG. 6A bend toward the lower side of the edging 40, the common side of the edging 40 is the lower side of the edging 40 in FIG. 6A.

Figure 6C:
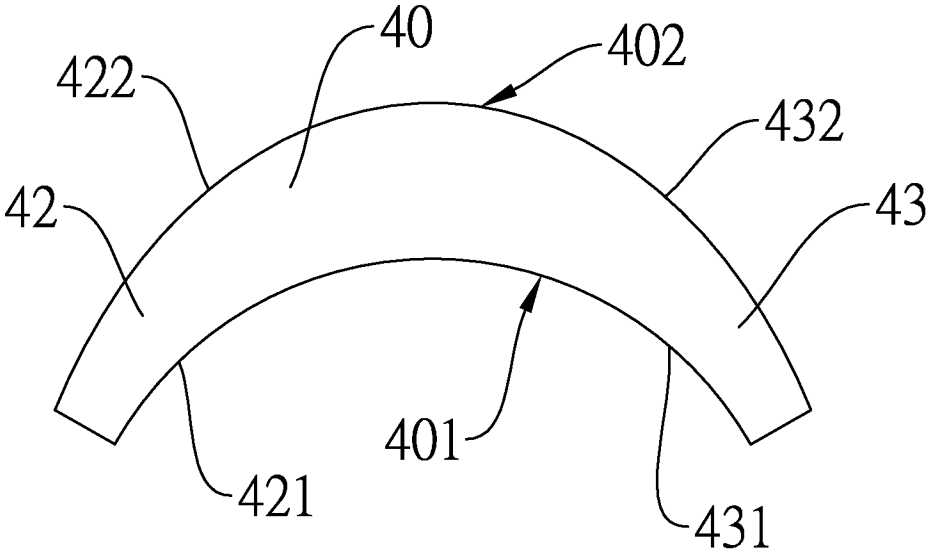

Referring to FIG. 6C, which is another implementation of the sixth embodiment, wherein the lower side edge 401 and the upper side edge 402 of the edging 40 are arced, the lower side edge 401 and the upper side edge 402 bend toward the glove palm 10, the curvature of the lower side edge 401 is larger than, less than or equal to the curvature of the upper side edge 402, and the curvature of the lower side edge 401 is larger than 0. Preferably, the curvature of the lower side edge 401 is less than the curvature of the upper side edge 402, thus the width of the location which the left wing portion 42 is connected to the right wing portion 43 is larger than the width of the terminal of the left wing portion 42, and the width of the location which the left wing portion 42 is connected to the right wing portion 43 is larger than the width of the terminal of the right wing portion 43. Certainly and alternatively, the width of the location which the left wing portion 42 is connected to the right wing portion 43 may be less than the width of the terminal of the left wing portion 42, and the width of the location which the left wing portion 42 is connected to the right wing portion 43 may be less than the width of the terminal of the right wing portion 43. Since the lower side edge 401 and the upper side edge 402 bend toward the glove palm 10, the whole glove structure bend along the direction from the glove back 20 to the glove palm 10, and the three-dimensional structure fitting ergonomics is formed. Preferably, the curvature of the lower side edge 401 is less than that of the upper side edge 402, and this makes the glove back 20 more bend toward the glove palm 10, and the glove structure more fits the ergonomics.

Specifically, that the lower side edge 401 and the upper side edge 402 bend toward the common side of the edging 40 means the lower side edge 401 and the upper side edge 402 of the edging 40 are arced, a center of the curvature of the lower side edge 401 and a center of the curvature of the upper side edge 402 are located at the common side of the edging 40, such that the edging 40 is generally V-shaped (FIG. 6C). For example in FIG. 6C, the center of the curvature of the lower side edge 401 and the center of the curvature of the upper side edge 402 are located at the lower side of the edging 40, the common side of the edging 40 is the lower side of the edging 40 in FIG. 6C. Or alternatively, that the lower side edge 401 and the upper side edge 402 bend toward the common side of the edging 40 means the left-lower edge 421 and the right-lower edge 431 have a lower angle θ1 therebetween, and the left-upper edge 422 and the right-upper edge 432 have an upper angle θ2 therebetween, wherein the lower angle θ1 is less than 180 degrees, such that the edging 40 is generally V-shaped (FIG. 6A), and the upper angle θ2 is less than 180 degrees.

Figure 6D:
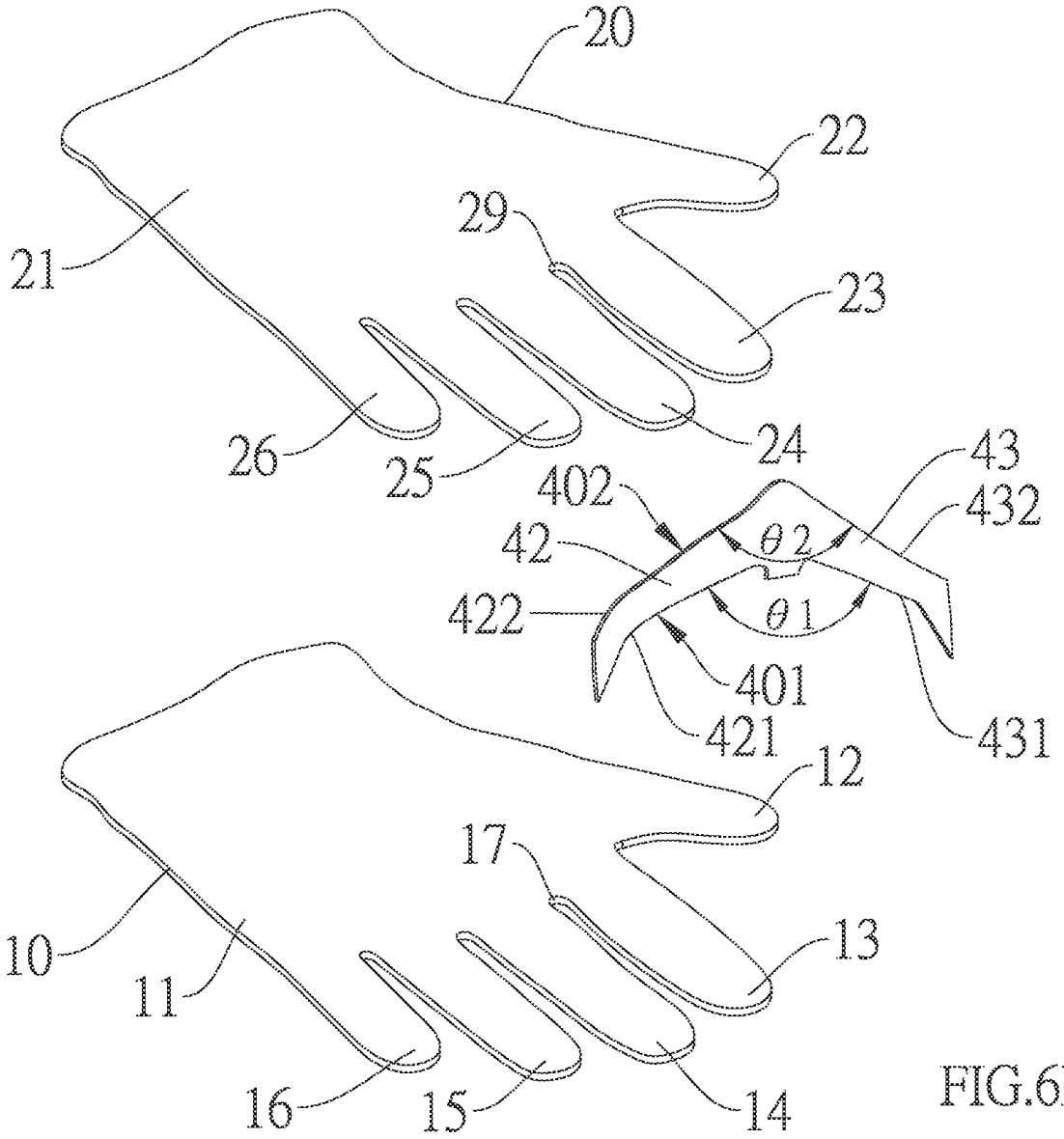

Referring to FIG. 6D, which is another implementation of the sixth embodiment, wherein the lower side edge 401 of the at least one edging 40 is adhered to two adjacent fingers of the first fingers portion via the joining region 41, and the upper side edge 402 is adhered to two adjacent rear fingers of the second fingers portion via the other one joining region 41. The left-lower edge 421 is connected to one finger of the two adjacent fingers, the right-lower edge 431 is connected other one finger of the two adjacent fingers, the left-upper edge 422 is connected to one rear finger of the two adjacent rear fingers, and the right-upper edge 432 is connected other one rear finger of the two adjacent rear fingers. A location which the two adjacent fingers are connected to each other form a V-shaped portion 17, the V-shaped portion 17 is also a location which the glove palm portion 11 is connected to the finger, and a location which the left-lower edge 421 is connected to the right-lower edge 431 is adhered to the V-shaped portion 17 via the joining region 41. A location which the two adjacent rear fingers are connected to each other form an U-shaped portion 29, the U-shaped portion 29 is also a location which the back portion 21 is connected to the rear finger, and a location which the left-upper edge 422 is connected to the right-upper edge 432 is adhered to the U-shaped portion 29 via the other one joining region 41. A terminal of the left-lower edge 421 and a terminal of the right-lower edge 431 are respectively adhered to two terminals of the two adjacent fingers via the joining region 41, and a terminal of the left-upper edge 422 and a terminal of the right-upper edge 432 are respectively adhered to two terminals of the two adjacent rear fingers via the other one joining region 41. Next, with the configuration that the upper angle θ2 is less than or equal to the lower angle θ1 or the curvature of the lower side edge 401 is less than or equal to the curvature of the upper side edge 402, the two fingers can bend toward the glove palm 10 by utilizing merely one edging 40, the finger and the glove palm 10 have the non-flat angle therebetween, thus making the glove structure fit the ergonomics and meet the requirements of any working states, and saving the utilizing number of the edging 40. That is, the implementation herein is more economic than the above implementations.

For example, the lower side edge 401 of the at least one edging 40 is adhered to the index finger 13 and the middle finger 14 of the two adjacent fingers of the first fingers portion via the joining region 41, and the upper side edge 402 of the at least one edging 40 is adhered to the rear index finger 23 and the rear middle finger 24 of the two rear adjacent fingers of the second fingers portion via the other one joining region 41. The left-lower edge 421 is connected to the index finger 13, the right-lower edge 431 is connected to the middle finger 14, the left-upper edge 422 is connected to the rear index finger 23, and the right-upper edge 432 is connected to the rear middle finger 24. The index finger 13 and the middle finger 14 are connected to form the V-shaped portion 17, and the location which the left-lower edge 421 and the right-lower edge 431 are connected to each other is connected to the V-shaped portion 17 via the joining region 41. The rear index finger 23 and the rear middle finger 24 are connected to form the U-shaped portion 29, and the location which the left-upper edge 421 and the right-upper edge 432 are connected to each other is connected to the u-shaped portion 29 via the other one joining region 41. Specifically, terminals of the left-lower edge 421 and the right-lower edge 431 are respectively adhered to terminals of the index finger 13 and the middle finger 14 via the joining region 41, and terminals of the left-upper edge 422 and the right-upper edge 432 are respectively adhered to terminals of the rear index finger 23 and the rear middle finger 24 via the other one joining region 41. Therefore, the index finger 13 and the middle finger 14 can bend toward the glove palm 10 by merely one edging 40, "the index finger 13 and the middle finger 14" and the glove palm 10 have a non-flat angle therebetween, and thus the glove structure fit ergonomics and meet the requirements of any working states.

Figure 6E:
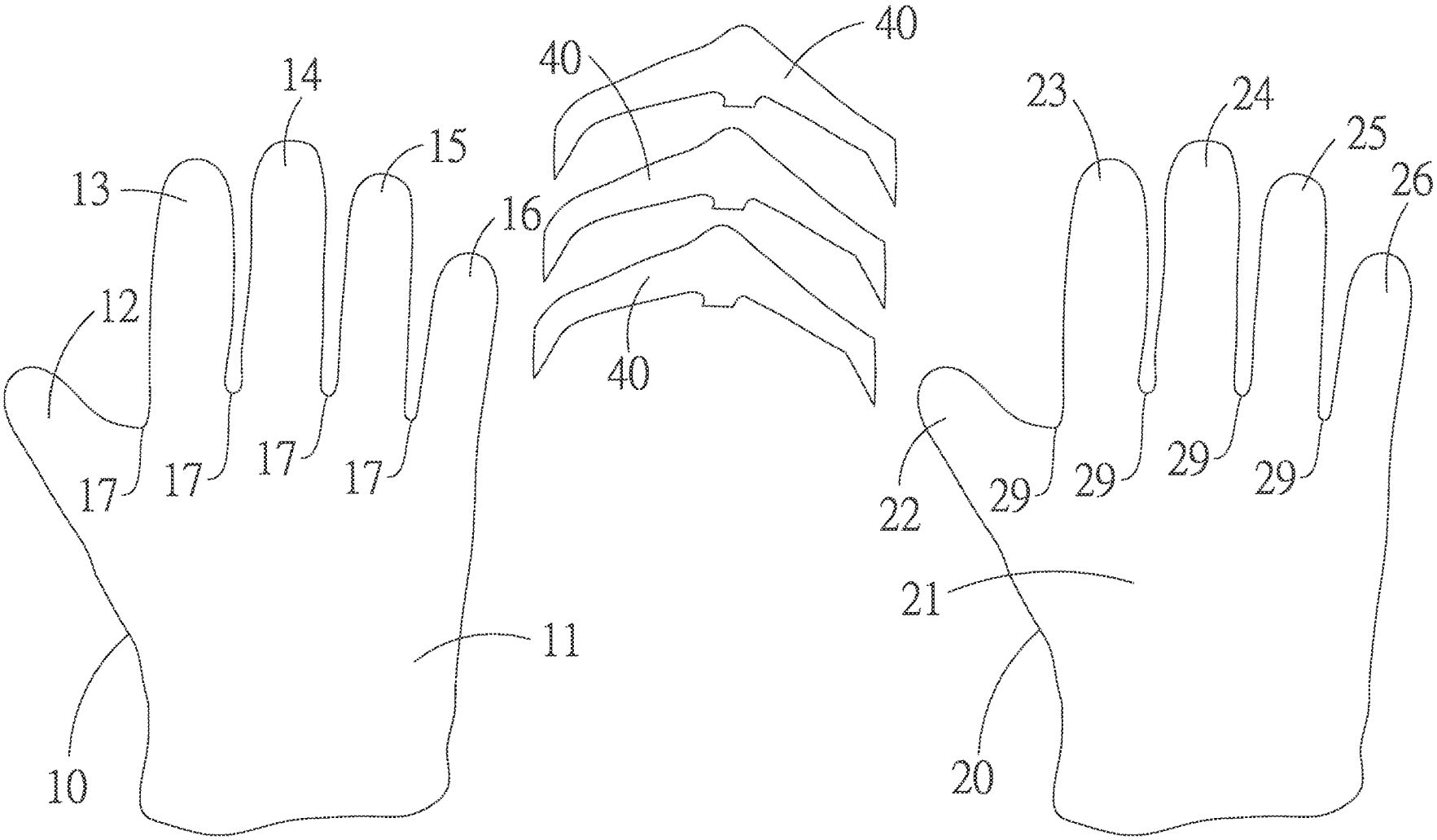

Certainly, the sixth embodiment can be implemented as the implementation of FIG. 6E, via the joining regions 41, the three edgings 40 are adhered to the three V-shaped portions 17 formed by the index finger 13, the middle finger 14, the ring finger 15 and the little finger 16 and the three U-shaped portions 29 formed by the rear index finger 23, the rear middle finger 24, the rear ring finger 25 and the rear little finger 26.

The following provides various manufacturing methods that are able manufacture the glove structure of the present invention.

Figure 7A:
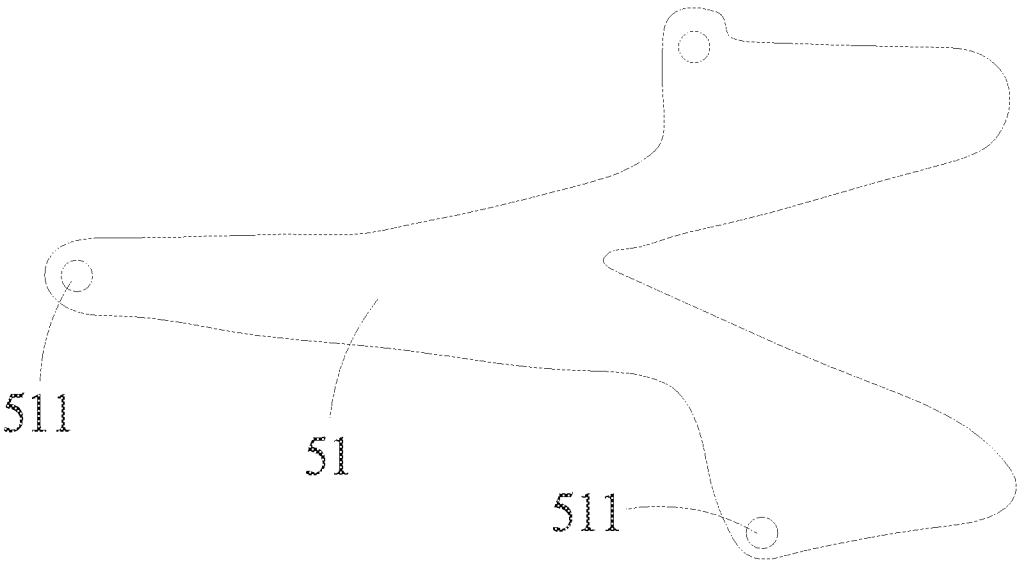
FIGS. 7A-7C are schematic views of a manufacturing process of the glove of the present invention.

A first manufacturing method, which is used as an example to manufacture the glove structure of the sixth embodiment, comprises at least the following steps:

(a) Provide at least one component mold 51, as shown in FIG. 7A, wherein the component mold 51 is provided with at least one first fixing member (not shown in the drawing), which enables rigid fixing of edgings. Adhesive interface materials (which may be attached using methods such as sticking with an adhesive coating or pasting with glue) are provided on peripheral areas of the edgings. The component mold 51 is further provided with at least second fixing members 511, wherein the first fixing member can be a magnetic member (such as a magnet), peg, slide plate, or a spring.

(b) Provide the glove palm 10, as shown in FIG. 6A, wherein the thumb 12, the index finger 13, the middle finger 14, the ring finger 15, and the little finger 16 of the first fingers portion integrally extend from and are formed on one side of the glove palm portion 11.

Figure 7B:
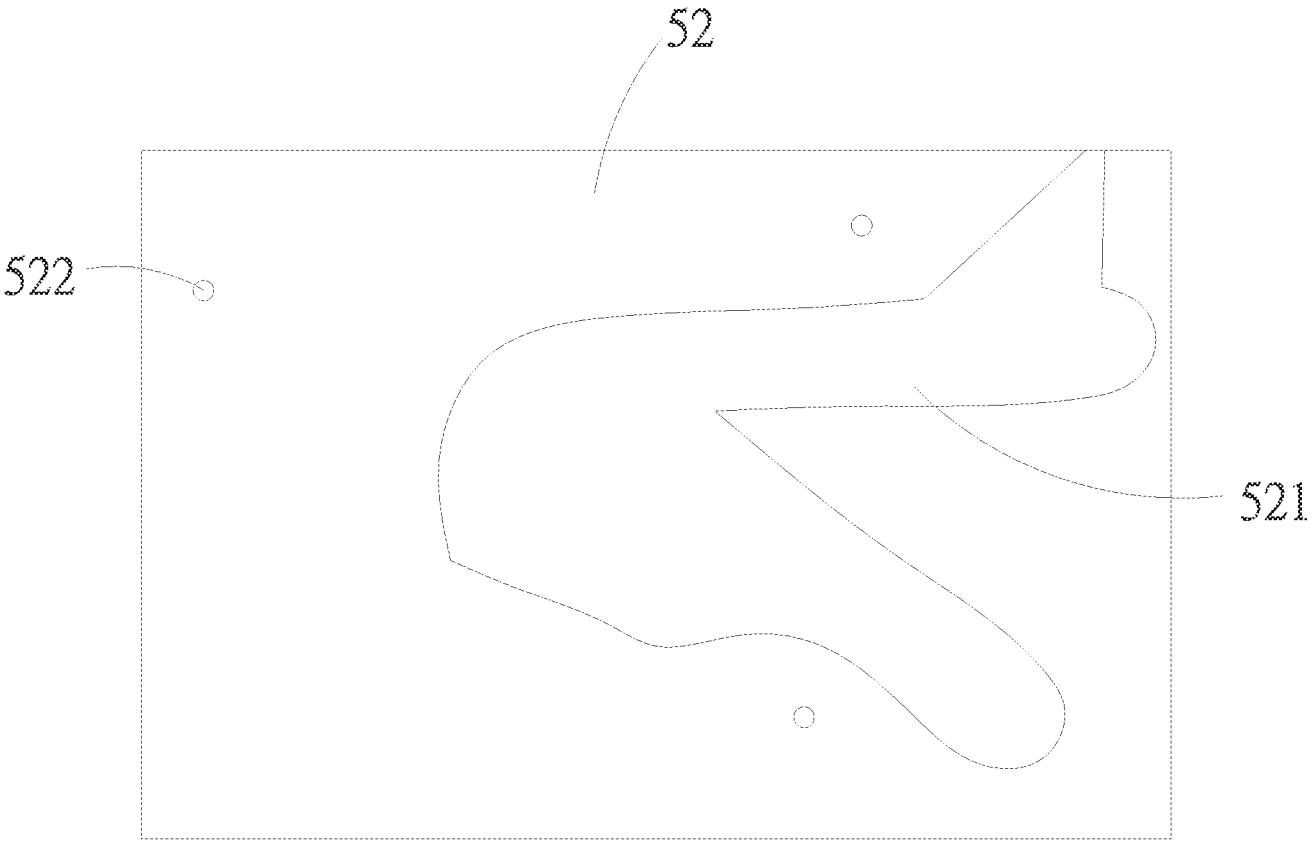

(c) Provide at least one component base 52, as shown in FIG. 7B, wherein one side of the component base 52 is provided with a retaining portion 521 that is able to retain a glove back. The retaining portion 521 has a structure corresponding to the external form of the glove back. As an example, the component base 52 respectively bonds to each edging and the second fingers portion of the glove back. Accordingly, the retaining portion 521 can respectively be the external form of a rear index finger and a rear middle finger, the external form of a rear middle finger and a rear ring finger, and the external form of a rear ring finger and a rear little finger. Moreover, the retaining portion 521 can be indented into the structural body of the component base 52, and can also protrude from the structural body of a mold base. Furthermore, the component base 52 is also configured with at least one third fixing member 522 to enable mutual correspondence with a second fixing member of a component mold.

(d) Join the glove palm to each edging, place the glove back on the component base 52, align the positions of the edgings to be bonded to correspond with the retaining portion 521 area, and then place a component mold of the fixed edgings to be bonded on the component base 52. Finally, join the glove back to the edgings using a compression bonding method. Accordingly, step (d) respectively forms fixed bonding of three edgings to the glove back.

Figure 7C:
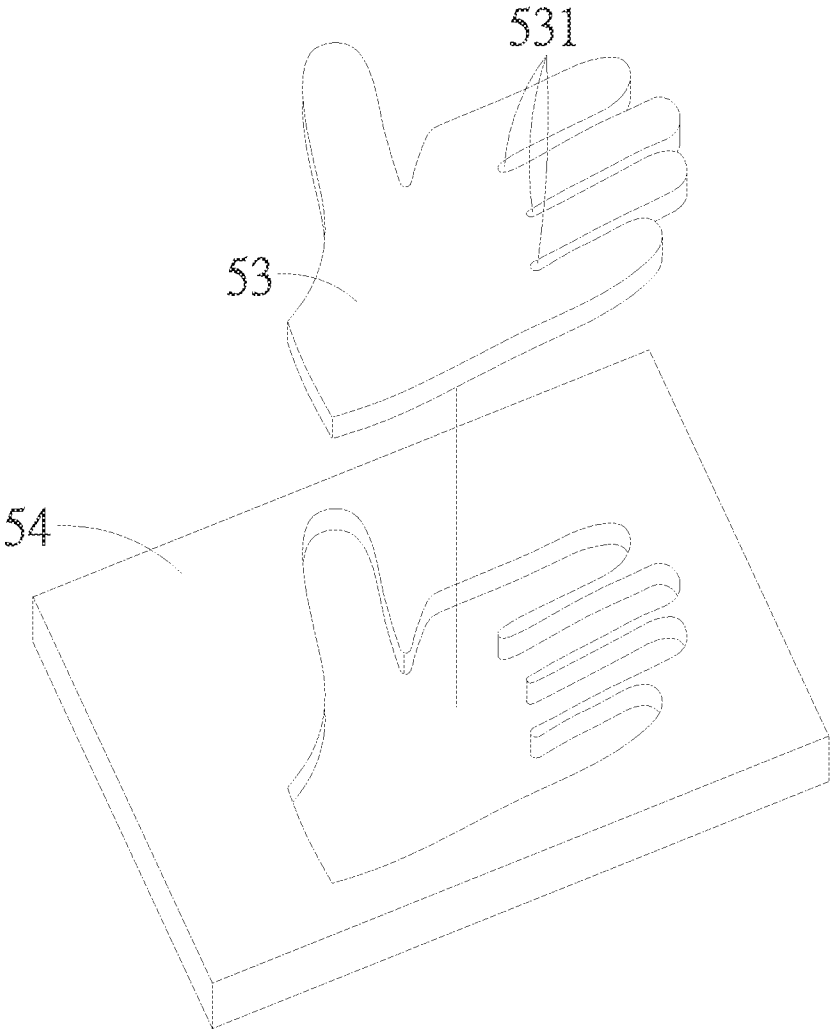

(e) Join the glove palm to the glove back, and provide a hand shaped mold 53 and a hand shaped mold base 54, as shown in FIG. 7C, wherein the hand shaped mold 53 has an external form corresponding to the glove back, and is provided with Y portions 531 located on the second fingers portion. Moreover, the hand shaped mold base 54 has an external form corresponding to the glove palm. The aforementioned completed glove back is placed beneath the hand shaped mold 53, and the Y portions 531 enable the peripheral areas of edgings to form an upright form. The glove palm is then placed on the hand shaped mold base 54, after which the glove back configured with the edgings is superposed on the hand shaped mold base 54, enabling the peripheral areas of the edgings to form an upright form using the Y portions 531. Accordingly, the upright sections of the edgings are fixedly bonded to the glove palm. Finally, the completed glove structure of the present invention is released from the mold.

The steps comprising a second manufacturing method are basically the same as the first manufacturing method, the difference lies in the first step of the second manufacturing method, which provides an automatic conveying device that automatically conveys the preformed glove palms and the glove backs or edgings. A first work station is installed on the automatic conveying device to carry out attachment of the adhesive interface materials, such as sticking with an adhesive coating or pasting with glue, or a glue sprayer can be installed to carry out glue spraying, to form adhesive layers with a thickness of 0.5~0.9 mm and a width of 2~8 mm. A second work station is installed after the first work station, and the second work station carries out a heating process, whereby the plurality of glove components attached with adhesive interface materials are heated. A baking method can be used to carry out the heating, wherein the heating temperature is 50~70 degrees centigrade, with a preferred temperature of 60 degrees centigrade.

Furthermore, a third work station is installed after the second work station, and the third work station carries out the aforementioned step (d) to bond together the glove palm and each edging. The bonding time only requires simple compression to complete the fixed bonding, for example, compress together for approximately 5~15 seconds to complete the bonding. Next, the manufacturing process sequentially carries out the aforementioned step (e) to complete the glove back, and step (f) to join together the glove palm and the glove back. Finally, the completed glove structure of the present invention is released from the mold.

A third manufacturing method, which is used as an example to manufacture the glove structure of the first embodiment, comprises at least: providing a hand shaped mold and a hand shaped mold base, which have external forms corresponding to the glove palm and the glove back. The glove palm is placed on the hand shaped mold base, and the glove back is placed beneath the hand shaped mold to enable joining regions on peripheral areas of the glove back to form upright shapes using the side surfaces of the hand shaped mold, and then adhesive interface materials are attached on the regions to be bonded (using attachment methods such as sticking with an adhesive coating or pasting with glue). Finally, compression bonding is carried out to fixedly bond together the glove palm and the glove back.

Figure 8:
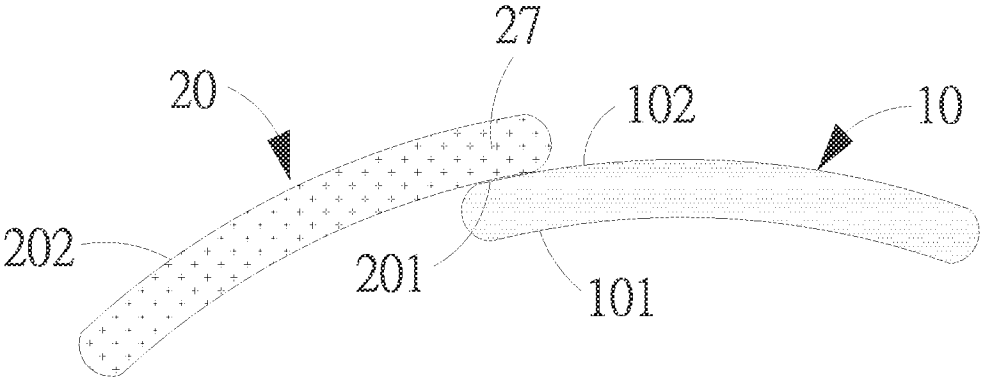
FIG. 8 is a structural schematic view of a seventh embodiment of the glove of the present invention.
Figure 9:
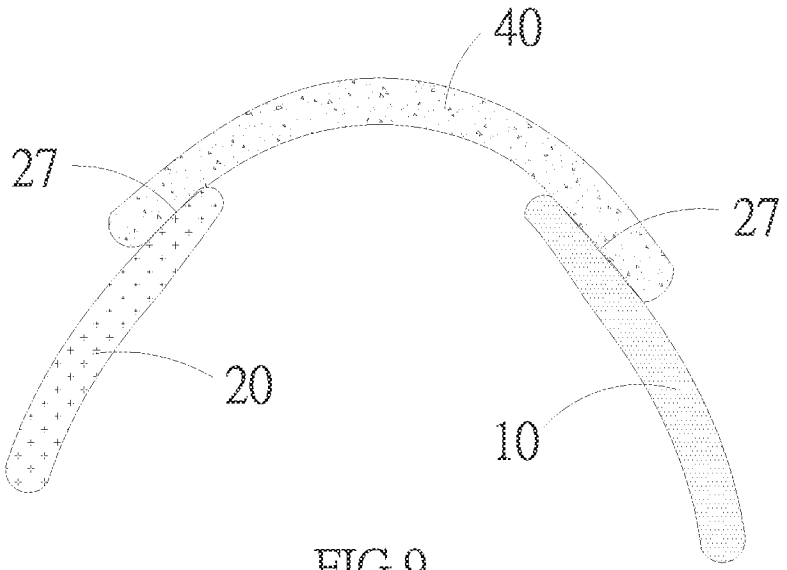
FIG. 9 is a structural schematic view of an eighth embodiment of the glove of the present invention.

In addition, in the aforementioned embodiment, a first internal surface of a first glove component and a second internal surface of a second glove component are used to form a holding space as an example to form a holding space to enable the user to insert their hand therein. It is understood that semi-finished components can also be used to produce the glove structure of the present invention. Referring to FIG. 8, wherein the first external surface 102 of a first glove component similarly uses the joining region 27 to bond to the second internal surface 201 of a second glove component. However, the limitation is that the first internal surface 101 and the second internal surface 201 have not yet formed a holding space. Referring to FIG. 9, wherein the edging 40 of a third glove component uses the joining regions 27 to bond to the first glove component and the second glove component.

Furthermore, in the aforementioned embodiments, in addition to using the mutual bonding of at least one first and second glove components to form the glove structure of the present invention, another joining region can be further used to bond to a glove liner. It is understood that the glove structure can use a roll back form from one side of the glove liner to cover another side of the glove liner to form a three-dimensional configuration that conforms to ergonomics design. And the aforementioned other joining region may be configured as a bonding layer (not shown in the drawings), which can be an adhesive interface material such as polyurethane (abbreviated to PU) or acrylate, which can be attached using methods such as sticking with an adhesive coating or pasting with glue. And the bonding layer is used to fixedly bond the glove structure to the glove liner. It is understood that high frequency, thermal compression bonding, or cold compression bonding methods can also be used to form the fixed bonding. In addition, in the aforementioned embodiments, the surface of the glove structure is provided with at least one decorative portion, for example, decorative lines can serve as a decorative portion on at least one peripheral area of the surface of the glove structure, wherein the decorative lines give the user the feeling that the glove has been stitched.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A glove structure, wherein the glove structure comprises at least:

a first glove component being a glove palm which has a glove palm portion and a first fingers portion located on one side of the glove palm portion, wherein the first fingers portion comprises a plurality of fingers;

a second glove component being a glove back which has a back portion and a second fingers portion located on one side of the back portion, wherein the second fingers portion comprises a plurality of rear fingers; and at least a third glove component being an edging, the edging is a bent sheet, the edging has a left wing portion and a right wing portion connected to the left wing portion, a left-lower edge of the left wing portion and a right-lower edge of the right wing portion are connected to each other to form a lower side edge, and a left-upper edge of the of the left wing portion and a right-upper edge of the right wing portion are connected to each other to form an upper side edge; the lower side edge is adhered to at least one portion of the glove palm via a joining region, the upper side edge is adhered to at least one portion of the glove back via another joining region, and the lower side edge and the upper side edge bend toward a common side of the edging.

2. The glove structure according to claim 1, wherein the lower side edge is bent toward the glove palm.

3. The glove structure according to claim 2, wherein that the lower side edge and the upper side edge bend toward the common side of the edging means the lower side edge and the upper side edge of the edging are arced, a center of curvature of the lower side edge and a center of curvature of the upper side edge are located at the common side of the edging, and the curvature of the lower side edge is larger than 0.

4. The glove structure according to claim 3, wherein the curvature of the lower side edge is less than the curvature of the upper side edge, a width of a location at which the left wing portion is connected to the right wing portion is larger than a width of a terminal of the left wing portion, and the width of the location at which the left wing portion is connected to the right wing portion is larger than a width of a terminal of the right wing portion.

5. The glove structure according to claim 4, wherein two sides which the left wing portion and right wing portion are connected to each other are respectively connected to a location at which the glove palm portion is connected to the finger and a location at which the back portion is connected to the rear finger.

6. The glove structure according to claim 2, wherein that the lower side edge and the upper side edge bend toward the common side of the edging means the left-lower edge and the right-lower edge have a lower angle therebetween, and the left-upper edge and the right-upper edge have an upper angle therebetween; the lower angle is less than 180 degrees, and the upper angle is less than 180 degrees.

7. The glove structure according to claim 6, wherein the upper angle is less than the lower angle, a width of a location at which the left wing portion is connected to the right wing portion is larger than a width of a terminal of the left wing portion, and the width of the location at which the left wing portion is connected to the right wing portion is larger than a width of a terminal of the right wing portion.

8. The glove structure according to claim 7, wherein two sides which the left wing portion and right wing portion are connected to each other are respectively connected to a location at which the glove palm portion is connected to the finger and a location at which the back portion is connected to the rear finger.

9. The glove structure according to claim 2, wherein the lower side edge of the edging is adhered to two adjacent fingers of the first fingers portion via the joining region, and the upper side edge is adhered to two adjacent rear fingers of the second fingers portion via the other one joining region.

10. The glove structure according to claim 9, wherein the left-lower edge is connected to one finger of the two adjacent fingers, the right-lower edge is connected to other one finger of the two adjacent fingers, the left-upper edge is connected to one rear finger of the two adjacent rear fingers, the right-upper edge is connected to other one rear finger of the two adjacent rear fingers.

11. The glove structure according to claim 10, wherein a location at which the two adjacent fingers are connected to each other form a V-shaped portion, the V-shaped portion is also a location at which the glove palm portion is connected to the finger, and a location at which the left-lower edge is connected to the right-lower edge is adhered to the V-shaped portion via the joining region; a location at which the two adjacent rear fingers are connected to each other form an U-shaped portion, the U-shaped portion is also a location at which the back portion is connected to the rear finger, and a location at which the left-upper edge is connected to the right-upper edge is adhered to the U-shaped portion via the other one joining region.

12. The glove structure according to claim 11, wherein a terminal of the left-lower edge and a terminal of the right-lower edge are respectively adhered to two terminals of the two adjacent fingers via the joining region, and a terminal of the left-upper edge and a terminal of the right-upper edge are respectively adhered to two terminals of the two adjacent rear fingers via the other one joining region.

13. The glove structure according to claim 12, wherein the lower side edge and the upper side edge of the edging are arced, a curvature of the lower side edge is not larger than a curvature of the upper side edge, and the curvature of the lower side edge is larger than 0.

14. The glove structure according to claim 13, wherein the curvature of the lower side edge is less than the curvature of the upper side edge, a width of a location at which the left wing portion is connected to the right wing portion is larger than a width of a terminal of the left wing portion, and the width of the location at which the left wing portion is connected to the right wing portion is larger than a width of a terminal of the right wing portion.

15. The glove structure according to claim 14, wherein two sides which the left wing portion and right wing portion are connected to each other are respectively connected to a location at which the glove palm portion is connected to the finger and a location at which the back portion is connected to the rear finger.

16. The glove structure according to claim 12, wherein the left-lower edge and the right-lower edge have a lower angle therebetween, and the left-upper edge and the right-upper edge have an upper angle therebetween; the lower angle is less than 180 degrees, and the upper angle is less than 180 degrees; the upper angle is not larger than the lower angle.

17. The glove structure according to claim 16, wherein the upper angle is less than the lower angle, a width of a location at which the left wing portion is connected to the right wing portion is larger than a width of a terminal of the left wing portion, and the width of the location at which the left wing portion is connected to the right wing portion is larger than a width of a terminal of the right wing portion.

18. The glove structure according to claim 17, wherein two sides which the left wing portion and right wing portion are connected to each other are respectively connected to a location at which the glove palm portion is connected to the finger and a location at which the back portion is connected to the rear finger.

19. The glove structure according to claim 12, wherein the fingers comprises an index finger, a middle finger, a ring finger and a little finger; the rear fingers comprises a rear index finger, a rear middle finger, a rear ring finger and a rear little finger; the glove structure comprises three edgings being respectively adhered to three V-shaped portions which are formed at the index finger, the middle finger, the ring finger and little finger and three U-shaped portions which are formed at the rear index finger, the rear middle finger, the rear ring finger and rear little finger, via the joining regions.

20. The glove structure according to claim 1, wherein the joining region has a bonding layer.

* * * * *